US005630751A

United States Patent [19]

Hansen

[11] Patent Number: 5,630,751

[45] Date of Patent: May 20, 1997

[54] FIREHOUSE EXHAUST RECOVERY SYSTEM

[75] Inventor: Harold W. Hansen, Wilsonville, Oreg.

[73] Assignee: Energy Savings Products, Inc., Tualatin, Oreg.

[21] Appl. No.: 501,635

[22] Filed: Jul. 12, 1995

[51] Int. Cl.[6] ..... F23J 11/04

[52] U.S. Cl. ..... 454/64

[58] Field of Search ..... 454/63, 64

[56] References Cited

U.S. PATENT DOCUMENTS

| | | | |
|---|---|---|---|
| D. 338,610 | 8/1993 | Johansson | 8/358 |
| D. 357,303 | 4/1995 | Karlsson et al. | D23/209 |
| 3,941,041 | 3/1976 | Sprout | 454/64 |
| 4,660,465 | 4/1987 | Jentzsch et al. | 454/64 |
| 4,762,054 | 8/1988 | Melville et al. | 454/64 |
| 5,162,017 | 11/1992 | Nordin | 454/63 |
| 5,222,906 | 6/1993 | Lundstrom | 454/64 |
| 5,362,273 | 11/1994 | Pfeiffer, Jr. et al. | 454/63 |
| 5,397,266 | 3/1995 | Nordin | 454/63 |
| 5,409,269 | 4/1995 | Karlsson et al. | 285/166 |

FOREIGN PATENT DOCUMENTS

| | | | |
|---|---|---|---|
| 30845 | 4/1885 | Germany | 454/64 |
| 1339874 | 12/1973 | United Kingdom | 454/64 |

OTHER PUBLICATIONS

Tykron Products, Roberts–Gordon, Inc. Emergency Vehicles brochure.

Tykron Products, Tygrip Assembly, drawing #Figure 12, Oct. 20, 1993.

Tykron Products, 50 Foot Roller Rail System, drawing #AWTKJ–0035, Jan. 14, 1994.

Tykron Products, 50 Foot Tandem Roller Rail System, drawing #AWTKU–0036, Jan. 14, 1994.

Tykron Products, Flexible Fume Removal Arms brochure.

Photographs of Car–Mon; Plymovent; Nederman; Magnatrack; Plymovent; and Amerman exhaust systems.

*Primary Examiner*—Harold Joyce

*Attorney, Agent, or Firm*—Chernoff, Vilhauer, McClung & Stenzel

[57] ABSTRACT

An exhaust recovery system to vent exhaust from an exhaust pipe of a vehicle within a building. A coupling is detachably connectable to the exhaust pipe of the vehicle. An elongate flexible hose is interconnected between the coupling and a telescoping assembly. The telescoping assembly includes a plurality of tubular members slidably engaged within one another. As the vehicle is moved away from the telescoping assembly it causes the tubular members to slide with respect to one another permitting the vehicle to exit the building while exhaust from the vehicle passes through the hose and the telescoping assembly.

10 Claims, 6 Drawing Sheets

FIREHOUSE EXHAUST RECOVERY SYSTEM

BACKGROUND OF THE INVENTION

The present invention relates to the collection and discharge of exhaust gases from motor vehicles. More particularly, the present invention relates to an exhaust recovery system for a building which delivers exhaust gases from motor vehicles operating therein to a discharge point outside of the building.

Exhaust gases from a vehicle operating within a closed environment, such as a building, needs to be removed in order to minimize injury to occupants from exposure to the exhaust gases, and particularly to occupants that work, live, or spend considerable time within the closed environment. In particular, removal of exhaust gases is critical for a fire station because the exhaust gases from operating vehicles, such as fire trucks, would be prevalent where the firemen work and sleep if not vented.

When responding to an emergency, the fire truck engine is started and exhaust gases are discharged into the fire station. Exhaust gases continue to be discharged into the fire station until the fire truck has driven out of the fire station. To prevent the discharge of exhaust gases into the fire station, an exhaust hose that is vented to the outside of the fire station could be manually connected to the fire truck's exhaust pipe prior to starting the fire truck. After the fire truck has exited the fire station, the exhaust hose may then be manually disconnected so that the fire truck may continue to the emergency. However, because of the inherent urgency of responding to emergencies it is undesirable to stop the fire truck after leaving the fire station to disconnect the exhaust hose from the fire truck's exhaust pipe. Further, when parking the fire truck within the fire station, the fire truck discharges exhaust gases into the fire station. Likewise, the exhaust hose should be connected to the exhaust pipe prior to parking the fire truck in the fire station.

Melville, et al., U.S. Pat. No. 4,762,054 discloses a vented exhaust extraction rail assembly that 5 includes a stationary top rail with an exhaust spout that slides along the rail. A flexible hose is interconnected between the exhaust spout and the exhaust pipe of a vehicle. Exhaust gases from the vehicle are vented through the flexible hose and rail assembly to the exterior of the building. However, the exhaust system is only oriented in a direction suitable to compensate for variable alignment of parallel parked vehicles. Accordingly, the exhaust system does not permit a vehicle to travel a significant distance in a transverse direction to the rail (toward the door) before the flexible hose is fully extended and thereby detaching the hose from the exhaust pipe. The inability of the vehicle to travel a significant distance prior to disconnection of the hose from the exhaust pipe may result in exhaust discharging into the building. Further, Melville suspends the flexible hose from the top rail at spaced-apart locations which results in looped portions of suspended hose which impedes the movement of workers within the building. In other words, the hose's suspended looped portion creates a work hazard to workers in the vicinity.

Nordin, U.S. Pat. No. 5,162,017, discloses an extendable hose connected to the exhaust pipe of a vehicle in such a way that the exhaust fumes from the vehicle are carried away via the hose. The hose is supported by an overhead runway at spaced-apart locations with trolleys that are moveable along the runway. However, when the hose is not fully extended, portions of the hose droop down between adjacent trolleys obstructing worker's movement in the area. Further, the Nordin system is expensive, in part because of the length of hose required, and the suspended flexible hose tends to wear out after repeated use.

Roberts-Gordon, Inc. of Buffalo, N.Y. markets an exhaust system, sold under the trademark TYKRON, that includes an exterior vent connected to an elevated stationary ball joint. A flexible hose is interconnected between the exhaust pipe of a vehicle, such as a fire truck, and the ball joint. To permit the vehicle to drive out of the building prior to the hose disconnecting from the vehicle, a series of spaced-apart saddles support the hose from an upper rail assembly. The upper rail assembly is aligned in the direction of vehicle travel as it enters and exits the building. As the vehicle drives out of the building, tension is exerted by the exhaust pipe on the hose to pull the trolleys along the upper rail, thereby extending the hose. When the hose is taut, the tension exerted automatically disconnects the hose from the exhaust pipe. Prior to extension, the loops of unextended hose hanging down obstruct workers movement creating a safety hazard. Additionally, the long length of hose with its spring-like character, generates a significant recoil of the hose into the building after detaching from the vehicle. The recoil results in damage to objects and injury to people in the vicinity. Furthermore, the ball joint, long hose, and railing system are expensive.

What is desired, therefore, is an exhaust recovery system that minimizes the length of hose required, eliminates the loops of suspended hose within the building, and reduces the hose's recoil when detached from the vehicle's exhaust pipe under tension.

SUMMARY OF THE INVENTION

The present invention overcomes the afore mentioned drawbacks and shortcomings of the prior art by providing an exhaust recovery system to vent exhaust from an exhaust pipe of a vehicle. A coupling is detachably connectable to the exhaust pipe of the vehicle. An elongate flexible hose is interconnected between the coupling and a telescoping assembly. The telescoping assembly includes a plurality of tubular members slidably engaged within one another. As the vehicle is moved away from the telescoping assembly it causes the tubular members to slide with respect to one another permitting the vehicle to exit the building while exhaust from the vehicle passes through the hose and the telescoping assembly.

Preferably when the vehicle causes the telescoping assembly to become fully extended, the tension applied to the hose disconnects the coupling from the exhaust pipe. This automatic detachment eliminates the need for manual detachment of the coupling from the exhaust pipe. Furthermore, the use of the telescoping assembly permits the use of a relatively short hose which reduces the hose's recoil when the coupling becomes detached from the exhaust pipe under tension. Further, the telescoping assembly eliminates the suspended loops of hose, thereby decreasing obstructions to the movement of workers in the area which increases safety.

The foregoing and other objectives, features, and advantages of the invention will be more readily understood upon consideration of the following detailed description of the invention, taken in conjunction with the accompanying drawings.

BRIEF DESCRIPTION OF THE INVENTION

Figure 1:
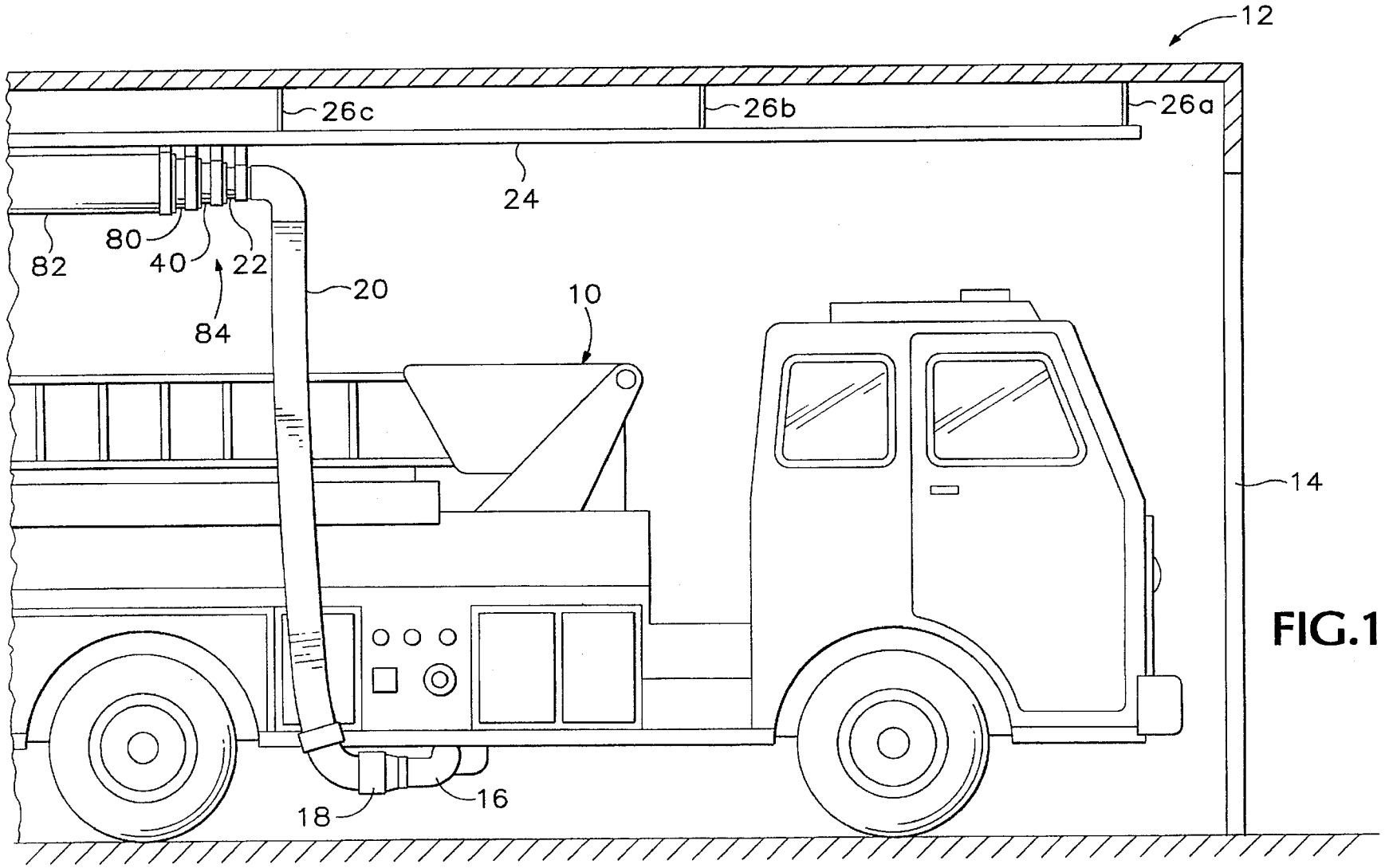
FIG. 1 is a partial sectional side view of a fire truck connected to a retracted exhaust recovery system within a fire station.

Referring to FIG. 1, a vehicle 10 is parked in a building 12, such as a fire truck within a fire station. The building 12 includes a front door 14 that is opened to permit the vehicle 10 to be driven into and out of the building 12. Rescue workers take significant risks when they respond to emergencies. However, their health should not be at risk when working and living within the fire station. Within seconds exposure to diesel or gasoline engine exhaust gases from vehicles operating within the building 12 may cause headaches and enough discomfort to hinder performance and reaction time. Prolonged exposure to trapped fumes can cause serious respiratory and other health problems.

To prevent the discharge of exhaust gases within the building 12 an exhaust recovery system is employed. A coupling 18 is affixed to the exhaust pipe 16. The coupling 18 includes a spring-loaded mechanical release that automatically disengages from the exhaust pipe 16 when sufficient tension is exerted on the coupling 18 by the vehicle 10 as it leaves the building 12. The preferred coupling 18 is sold by Roberts-Gordon, Inc. under the trademark TYKRON SPRING BOOT. Other types of detachable couplings are also acceptable. One end of a flexible hose 20, that extends under tension and retracts to its original length when not under tension, is connected to the coupling 18. The hose 20 is preferably constructed of a two layer material, including an abrasion resistant outer layer and silicon based inner layer for heat resistance, and further including an internal spiral wire. The other end of the hose 20 is connected to a telescoping assembly 84, described in greater detail later. The telescoping assembly is aligned with the vehicle 10 and includes multiple tubular members 22, 40, 80, and 82. The telescoping assembly 84 is vented to the exterior of the building (not shown).

As the vehicle 10 exits the building 12 the hose 20 connected to the exhaust pipe 16 extends the telescoping assembly 84. When the telescoping assembly 84 is fully extended, sufficient tension is exerted on the coupling 18 to detach it from the exhaust pipe 16. The hose's 20 length is selected such that no suspended loops of hose 20 exist between the tubular member 22 and the exhaust pipe 16. There is no need for the suspended loops of hose 20 because the telescoping assembly 84 provides an extension mechanism, other than the hose itself, to permit the vehicle to exit the building 12 prior to the disconnection of the hose 20 from the exhaust pipe 16. The elimination of the suspended loops of hose 20 reduces the hose's 20 length resulting in a reduction in the recoil of the hose 20 when it becomes detached under tension from the exhaust pipe 16 after the vehicle 10 exits the building 12. The reduction in the recoil of the hose 20 reduces the likelihood of injury to workers and damage to vehicles in the vicinity. Furthermore, the elimination of suspended portions of hose 20 reduces a significant safety hazard to workers in the area.

Figure 2A:
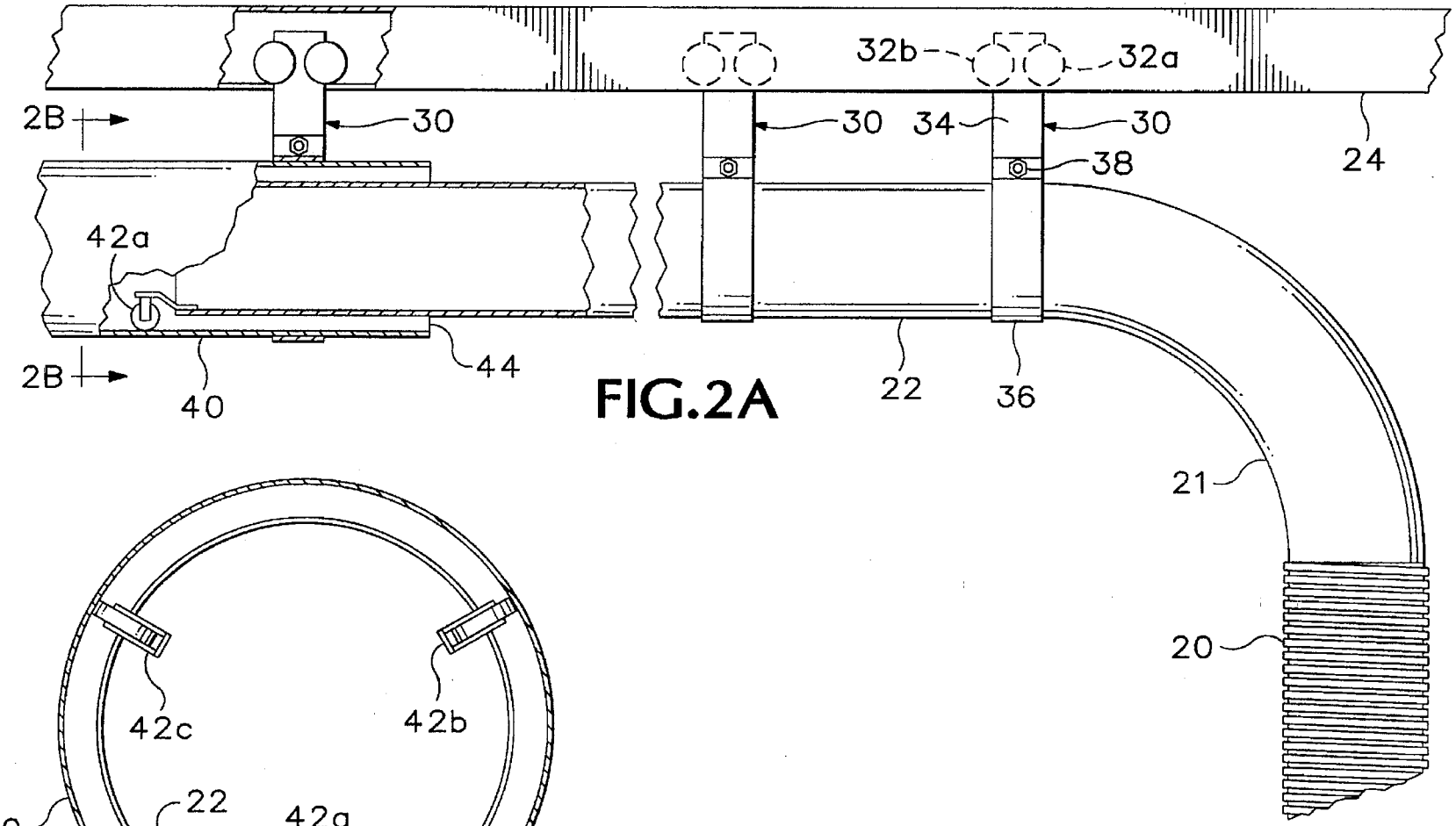
FIG. 2A is a partial sectional side view of a first embodiment of the exhaust recovery system shown in FIG. 1.

Referring to FIG. 2A, the hose 20 is preferably connected to an elbow 21, instead of directly to the tubular member 22, which eliminates the need to bend the hose 20 at the junction with the tubular member 22. A bent portion of tubular hose 20 results in a hose 20 that has a greater tendency to fail during repeated use.

A rail 24 is supported by supports **26*a*, 26*b*, and 26*c* from the building's ceiling or other suitable support. The rail 24 is preferably tubular with a down-wardly facing centrally disposed slot running longitudinally along its length to provide a convenient location to locate trolleys 30 therein. Each trolley 30 includes a pair of wheels 32*a* and 32*b* mounted on a vertical support 34. A circular bracket 36 shaped to tightly surround the exterior of the respective tubular member 22, 40, 80, and 82 is bolted with a bolt 38 to each support 34. Two trolleys 30 are provided to the tubular member 22 in a closely spaced-apart relationship to each other to provide additional structural support for the tubular member 22 because of the tension applied when extending the hose 20. The tubular member 22 is engaged within the larger tubular member 40 in a slidable relationship. The end of the tubular member 40 is supported by a trolley 30 and is centrally aligned with respect to the tubular member 22. Likewise, the tubular member 40 is slidably engaged with tubular member 80, which is slidably engaged with tubular member 82, all of which are centrally aligned with each other and supported by trolleys 30. The result is a plurality of tubular members 22, 40, 80, 82 and that are slidably engageable with one another in a centrally aligned relationship supported by a rail 24**.

Figure 2B:
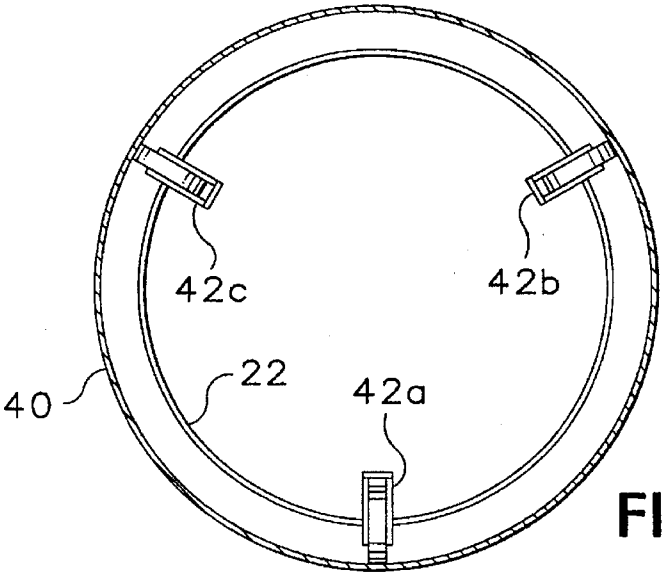
FIG. 2B is an end view taken along line 2B—2B of FIG. 2A showing three wheels between the tubular members.

Referring to FIGS. 2A and 2B, in a first embodiment the tubular member 22 includes a set of three wheels **42*a*, 42*b*, and 42*c* which ride on the inside surface of the tubular member 40. As the vehicle 10 exists the building 12 the tubular member 22 is pulled along the rail 24 until the wheels 42*a*, 42*b*, and 42*c* engage the end wall 44 of the tubular member 40. Thereafter, both tubular members 22 and 40 will be pulled along the rail 24 as a unit. The combination of the trolleys 30 and the three spaced-apart wheels 42*a*, 42*b*, and 42*c* permit the tubular members 40 and 22 to be properly aligned within one another as they move along the rail 24. Likewise, the remaining tubular members 40, 80, and 82** may include a similar wheel system.

Figure 3A:
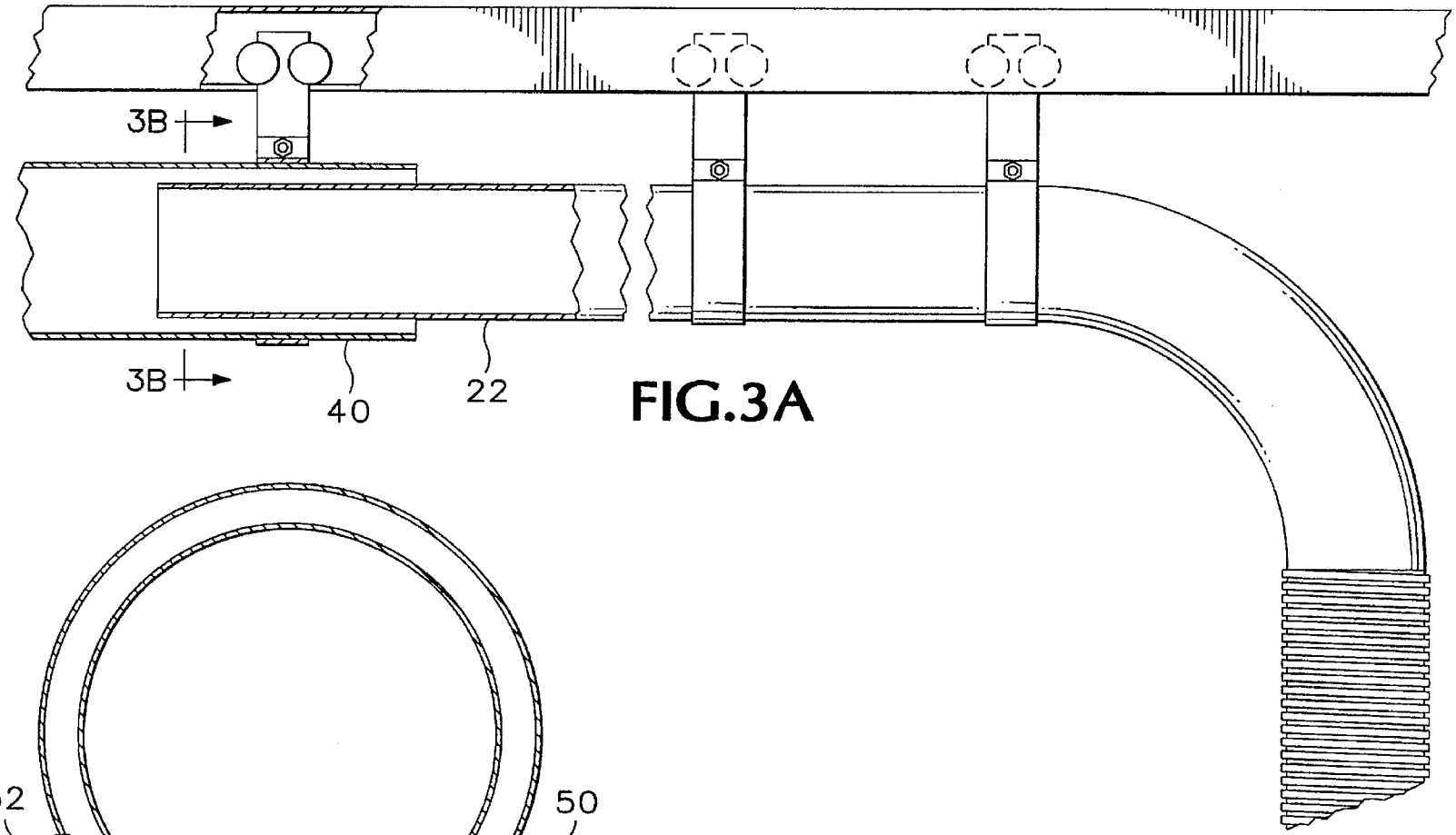
FIG. 3A is a partial sectional side view of a second embodiment of the exhaust recovery system shown in FIG. 2A.
Figure 3B:
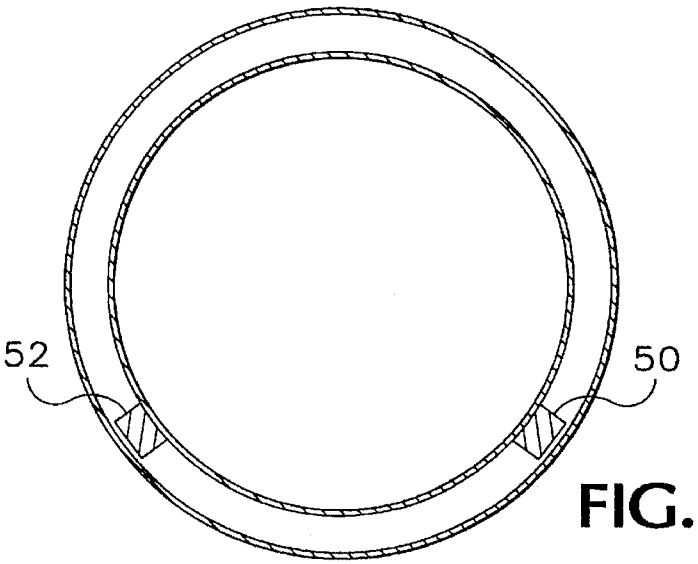
FIG. 3B is an end view taken along lines 3B—3B of FIG. 3A showing two block slides between the tubular members.

Referring to FIGS. 3A and 3B, an alternative sliding mechanism involves using a pair of spaced-apart sliding blocks 50 and 52 attached to the exterior surface of the tubular member 22 which slide on the inside surface of the tubular member 40. Preferably, the blocks 50 and 52 are constructed of plastic and are about six inches long. Likewise, the remaining tubular members 40, 80, and 82 may include a similar sliding block system.

Figure 4A:
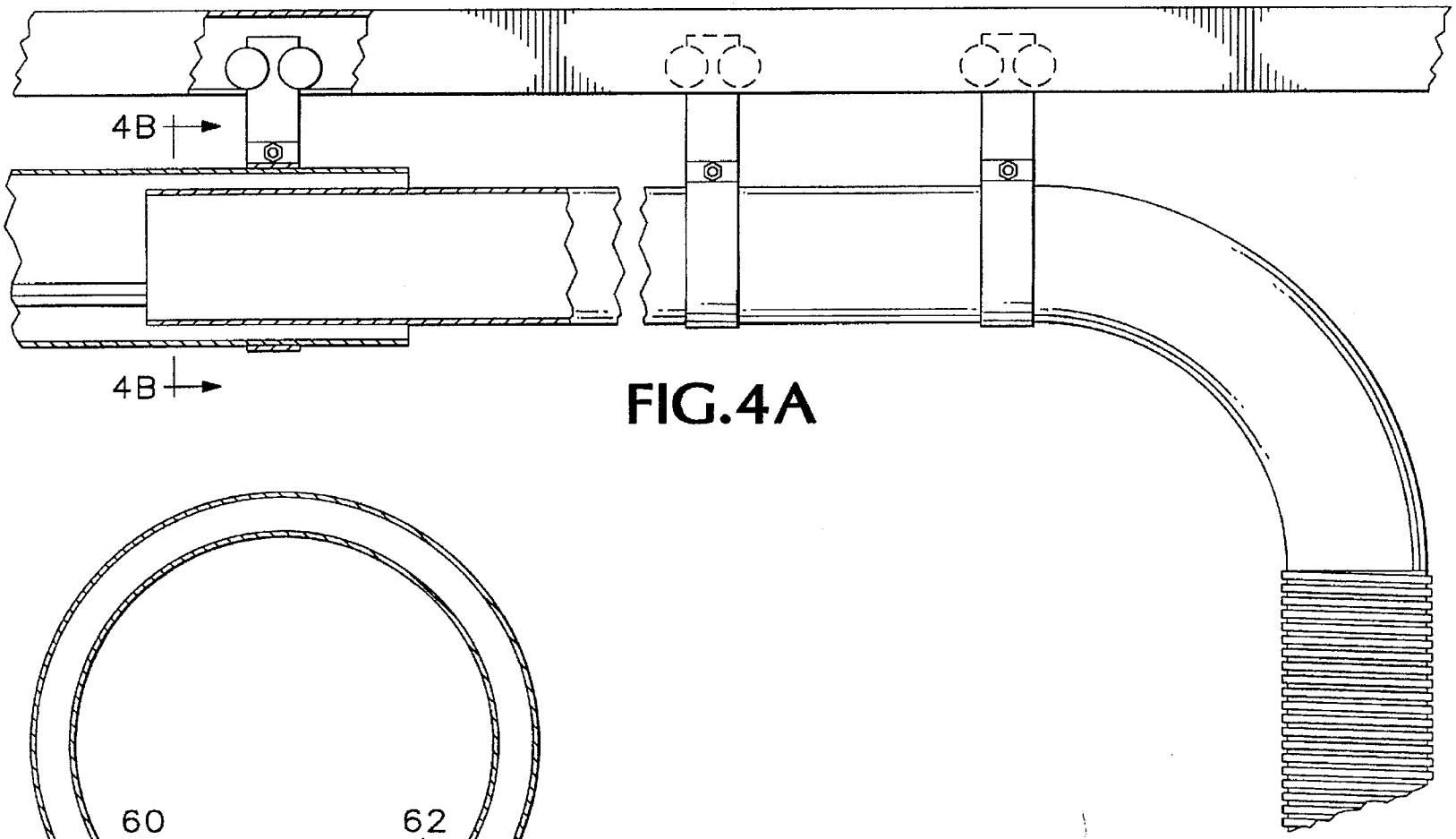
FIG. 4A is a partial sectional side view of a third embodiment of the exhaust recovery system shown in FIG. 1.
Figure 4B:
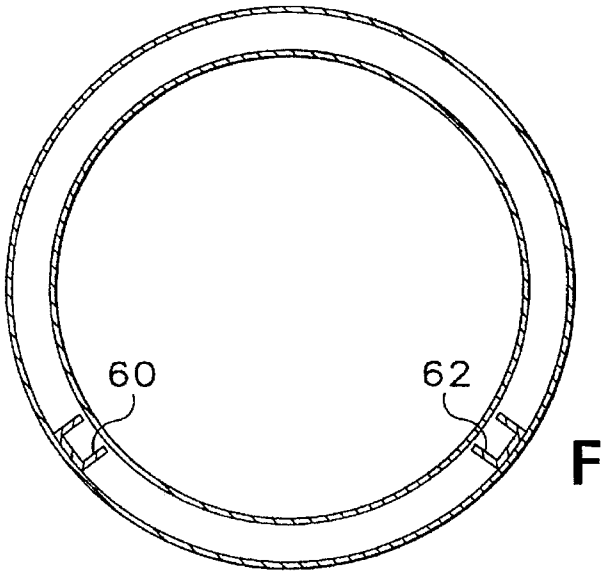
FIG. 4B is an end view taken along line 4B—4B of FIG. 4A showing two channel sliders between the tubular members.

Referring to FIGS. 4A and 4B, another alternative sliding mechanism involves using a pair of channel sliders 60 and 62 which are attached to the inside surface of the tubular member 40 and extend over the length of the tubular member 40. The exterior surface of the tubular member 22 slides on the sliders 60 and 62. Likewise, the remaining tubular members 40, 80, and 82 may include a similar channel slider system.

Figure 5A:
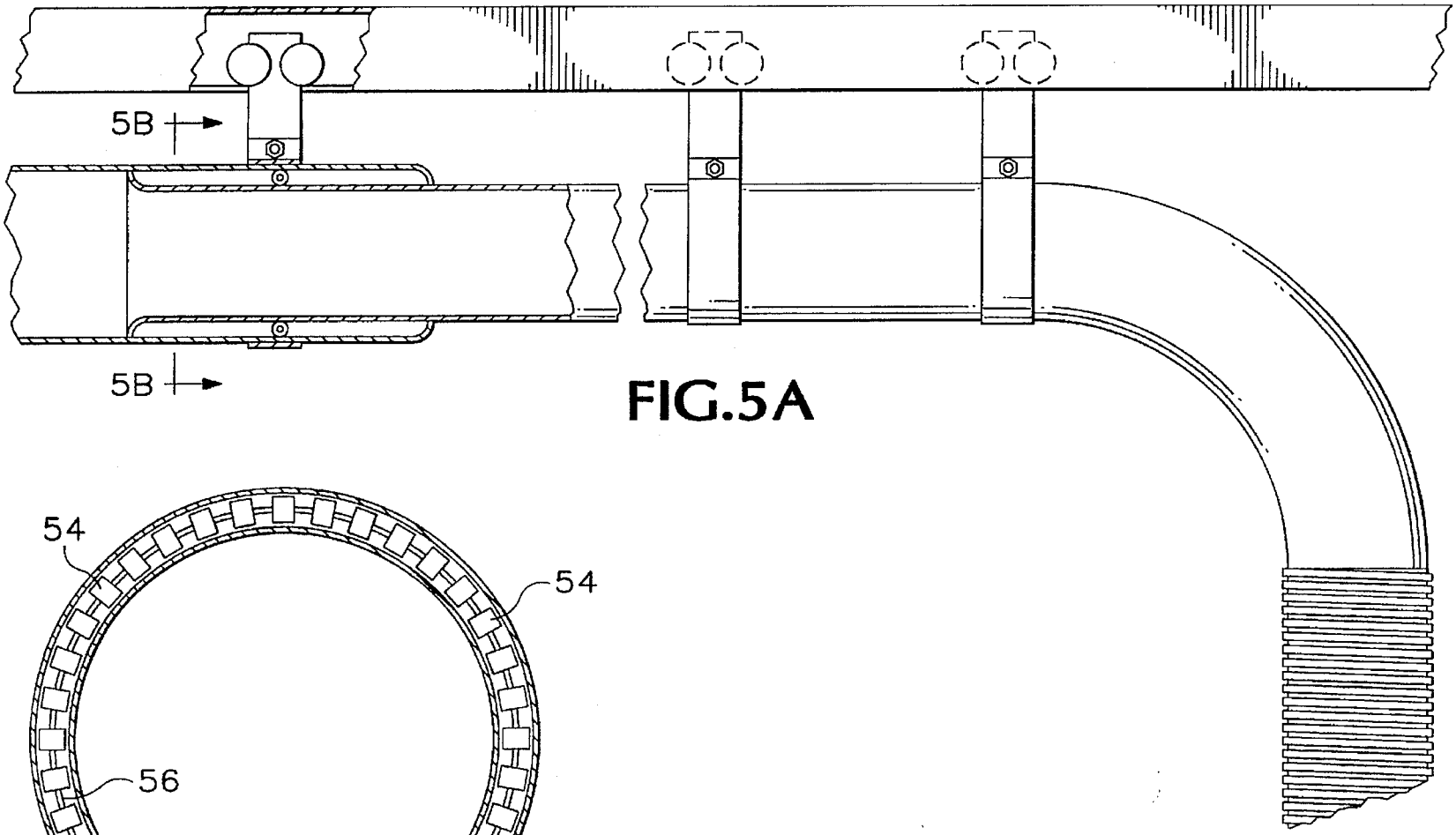
FIG. 5A is a partial sectional side view of a fourth embodiment of the exhaust recovery system shown in FIG. 1.
Figure 5B:
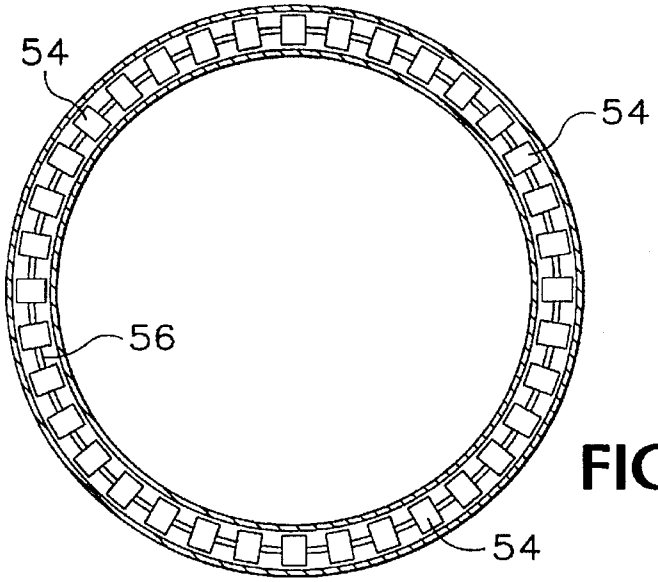
FIG. 5B is an end view taken along line 5B—5B of FIG. 5A showing multiple rollers on a wire between the tubular members.

Referring to FIGS. 5A and 5B, a further alternative sliding mechanism involves using a set of rollers 54 strung like beads on a wire ring 56. The ring 56 has a diameter half-way between the diameter of the tubular members 22 and 40. The exterior surface of the tubular member 22 and the interior surface of the tubular member 40 slide on the rollers 54. Likewise, the remaining tubular members 40, 80, and 82 may include a similar channel slider system.

Figure 6:
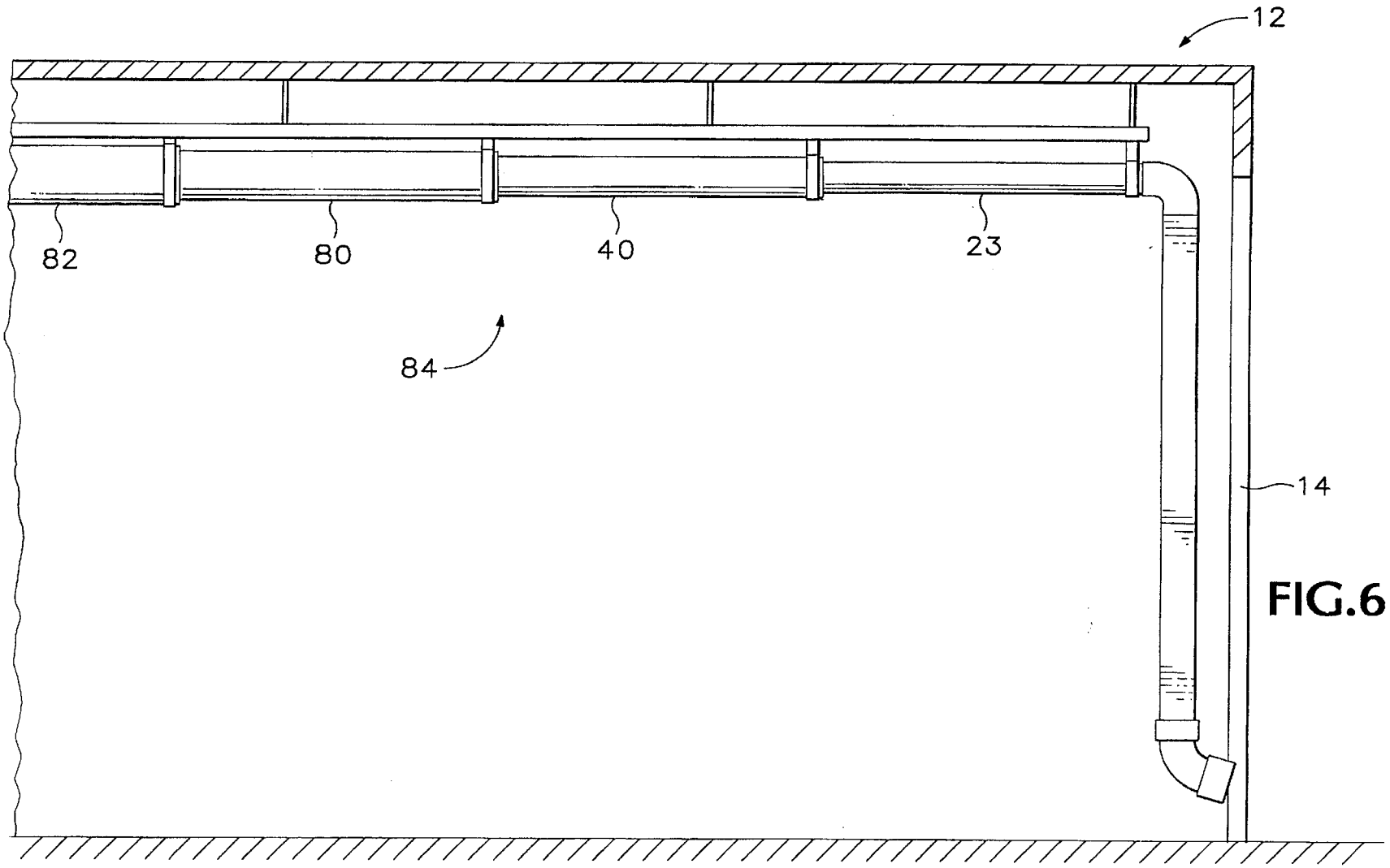
FIG. 6 is a partial sectional side view of an extended exhaust recovery system shown in FIG. 1.

Referring to FIG. 6, the preferred exhaust recovery system includes a set of four tubular members 22, 40, 80, and 82, each of a layer in diameter that when extended permit the vehicle 10 to exit the building 12 prior to disconnection of the coupling 18 from the exhaust pipe 16. In this way, exhaust gases are effectively prevented from escaping within the building 12. The tubular members 22, 40, 80, and 82 are preferably approximately 10 feet long and made of a durable tubular material, such as steel piping. Any number of sufficiently strong tubular members with a suitable length may be used. Further, any supporting and alignment system may be used so long as the tubular members are slidably engaged with one another. There is no need to make manual detachment of the exhaust system from the vehicle 12 because it automatically detaches once sufficient tension on the hose 20 is provided. Also, with slidably engaged members the length of hose required is kept to a minimum reducing a significant expense of prior systems.

Conversely, prior to parking the vehicle 10 within the building 12 the coupling 18 is attached to the exhaust pipe 16 and then the vehicle is driven into the building 12. The telescoping assembly 84 does not exert tension on the hose when fully extended, which occurs in the prior systems with a long suspended hose, so attaching the coupling 18 to the exhaust pipe 16 is performed under little, if any, tension which is more convenient.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An exhaust recovery system to vent exhaust from an exhaust pipe of a vehicle, located in an enclosed structure, as the vehicle is driven out of the structure, comprising:

(a) a coupling detachably connectable to the vehicle exhaust pipe;

(b) an elongate flexible hose having a first end and a second end, said first end of said hose connected to said coupling;

(c) a telescoping assembly including a plurality of elongate tubular members which includes at least a first tubular member and a second tubular member slidably engaged within one another;

(d) said second end of said hose connected to one of said tubular members; and (e) a tube supporting assembly separating an exterior surface of said first tubular member and an interior surface of said second tubular member from each other leaving an air gap therebetween substantially completely surrounding said first tubular member along a major portion of its length, said assembly including spacing elements interposed in said air gaps between said exterior surface of said first tubular member and said interior surface of said second tubular member, said spacing elements movably engaging at least one of said exterior surface and said interior surface.

2. The exhaust recovery system of claim 1 wherein said hose extends in a substantially straight line from said telescoping assembly to said exhaust pipe when not under tension.

3. The exhaust recovery system of claim 1 wherein said telescoping assembly is aligned in the general direction of travel of said vehicle as said vehicle exists a building.

4. The exhaust recovery system of claim 1 wherein at least two of said tubular members are engaged with each other with wheels.

5. The exhaust recovery system of claim 1 wherein at least two of said tubular members are engaged with each other with rollers.

6. The exhaust recovery system of claim 1 wherein at least two of said tubular members are engaged with each other with channel slides.

7. The exhaust recovery system of claim 1 wherein at least two of said tubular members are engaged with each other with block slides.

8. The exhaust recovery system of claim 1 wherein said telescoping assembly is supported by an upwardly disposed rail.

9. The exhaust recovery system of claim 1 wherein said hose extends, when not under tension, in a substantially straight line in a generally vertical direction from said second end connected to one of said tubular members to said first end connected to said exhaust pipe.

10. The exhaust recovery system of claim 1 further comprising:

(a) said telescoping assembly includes at least a first tubular member and a second tubular member;

(b) said second end of said hose connected to said first tubular member;

(c) the diameter of said first tubular member is substantially smaller than the diameter of said second tubular member;

(d) a substantial opening is defined between said first and second tubular members when engaged with one another such that a substantial volume of air is drawn through said substantial opening and mixed with said exhaust as said exhaust passes through said hose and said telescoping assembly.

* * * * *

UNITED STATES PATENT AND TRADEMARK OFFICE

CERTIFICATE OF CORRECTION

PATENT NO. : 5,630,751

DATED : May 20, 1997

INVENTOR(S) : Harold Hansen

It is certified that error appears in the above-indentified patent and that said Letters Patent is hereby corrected as shown below:

Col. 1, line 40, delete "5"
Col. 4, line 47, delete "exists" and add "exits"
Col. 6, line 21, (Claim #3), delete "exist" and add "exits"

Signed and Sealed this

Fourteenth Day of April, 1998

Bruce Lehman

*Attest:*

BRUCE LEHMAN

*Attesting Officer*

*Commissioner of Patents and Trademarks*